US005125317A

United States Patent [19]

Spektor et al.

[11] Patent Number: 5,125,317

[45] Date of Patent: Jun. 30, 1992

[54] APPARATUS FOR DETONATING MINES

[75] Inventors: Moshe Spektor; Gil Shalev, both of Beersheva, Israel

[73] Assignee: Israel Aircraft Industries Ltd., Lod, Israel

[21] Appl. No.: 704,059

[22] Filed: May 22, 1991

[30] Foreign Application Priority Data

May 29, 1990 [IL] Israel ..... 094544

[51] Int. Cl.[5] ..... F41H 11/12; F42B 22/42

[52] U.S. Cl. ..... 89/1.13; 102/402

[58] Field of Search ..... 89/1.13, 36.08; 102/402, 403; 171/141; 172/829

[56] References Cited

U.S. PATENT DOCUMENTS

| | | | |
|---|---|---|---|
| 4,021,725 | 5/1977 | Kirkland | 89/1.13 |
| 4,467,694 | 8/1984 | Azulai et al. | 89/1.13 |
| 4,491,053 | 1/1985 | Bar-Nefy et al. | 89/1.13 |
| 4,552,053 | 11/1985 | Bar-Nefy et al. | 89/1.13 |
| 4,590,844 | 5/1986 | Bar-Nefy et al. | 89/1.13 |
| 4,593,766 | 6/1986 | Gossard | 89/1.13 |
| 4,727,940 | 3/1988 | Bar-Nefy et al. | 89/1.13 |
| 4,840,105 | 6/1989 | Ladau et al. | 89/1.13 |
| 4,938,136 | 7/1990 | Gould | 102/402 |
| 4,951,571 | 8/1990 | Bane | 102/402 |

*Primary Examiner*—David H. Brown

*Attorney, Agent, or Firm*—Abelman Frayne & Schwab

[57] ABSTRACT

A vehicle mountable seismo-magnetic mine detonation system having apparatus, associable with a vehicle, for providing a seismic signal which, when sensed by a seismomagnetic mine, causes at least arming thereof when the vehicle is at at least a predetermined distance from the mine; and apparatus, associable with the vehicle, for modifying the magnetic field sensed by apparatus forming part of the seismomagnetic mine so as to at least cause arming thereof when the vehicle is at at least a predetermined distance from the mine, the apparatus for providing and apparatus for modifying cooperating so as to cause detonation of the mine at at least a predetermined distance from the mine without causing unacceptable damage to the vehicle or to its occupants.

28 Claims, 11 Drawing Sheets

APPARATUS FOR DETONATING MINES

FIELD OF THE INVENTION

The present invention relates to vehicle mountable mine clearing apparatus in general and, more particularly, to vehicle mountable seismo-magnetic mine clearing apparatus.

BACKGROUND OF THE INVENTION

It is known in tank warfare to employ mine clearing apparatus mounted on a vehicle for clearing a path through a mine field.

There is described in U.S. Pat. Nos. 4,491,053, 4,467,694, 4,552,053, 4,590,844 and 4,727,940 mine clearing apparatus mountable on a tracked vehicle and which includes a pair of plow members mounted in front of the vehicle tracks.

It would be advantageous to be able to provide vehicle mountable apparatus, considerably less bulky than the above-mentioned mine clearing apparatus, for prematurely detonating mines commonly found in modern mine fields, particularly seismo-magnetic mines.

SUMMARY OF THE INVENTION

It is an aim of the present invention to provide vehicle mountable apparatus for causing detonation of seismo-magnetic mines at a safe distance in front of the vehicle, thereby clearing a safely traversable path through a mine field.

There is provided, therefore, in accordance with a preferred embodiment of the invention, a vehicle mountable seismo-magnetic mine detonation system including apparatus, associable with a vehicle, for providing a predetermined seismic signal which, when sensed by a seismo-magnetic mine causes at least arming thereof when the vehicle is at at least a predetermined distance from the mine; the system also including apparatus, associable with the vehicle, for modifying the magnetic field sensed by apparatus forming part of the seismo-magnetic mine so as to at least cause arming thereof when the vehicle is at at least a predetermined distance from the mine, the apparatus for providing and apparatus for modifying cooperating so as to cause detonation of the mine without causing unacceptable damage to the vehicle or to its occupants.

In accordance with an alternative embodiment of the invention, there is provided, mobile mine clearing apparatus which includes a vehicle and a vehicle mountable seismo-magnetic mine detonation system, the system including apparatus, associated with the vehicle, for providing a predetermined seismic signal which, when sensed by a seismo-magnetic mine causes at least arming thereof when the vehicle is at at least a predetermined distance from the mine, the system also including apparatus, associable with the vehicle, for modifying the magnetic field sensed by apparatus forming part of the seismo-magnetic mine so as to cause at least arming thereof when the vehicle is at at least a predetermined distance from the mine, the apparatus for providing and apparatus for modifying cooperating so as to cause detonation of the mine without causing unacceptable damage to the vehicle or to its occupants.

In accordance with an embodiment of the invention, the apparatus for providing a seismic signal is operative to generate a seismic signal that is sensible by the mine when the vehicle is at a first distance therefrom and the apparatus for modifying is operative to modify the magnetic field sensed by apparatus forming part of the mine when the vehicle is at a second distance therefrom, the second distance being shorter than the first distance, such that the apparatus for providing a seismic signal causes initial arming of the mine, and the apparatus for modifying causes subsequent detonation of the mine.

Further in accordance with an embodiment of the invention the apparatus for providing is operative to generate a seismic signal having a frequency within a predetermined range of frequencies and having at least a predetermined intensity.

Additionally in accordance with an embodiment of the invention, the apparatus for providing includes apparatus for causing vibrations and for conducting the vibrations to a ground surface across which the vehicle is travelling.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
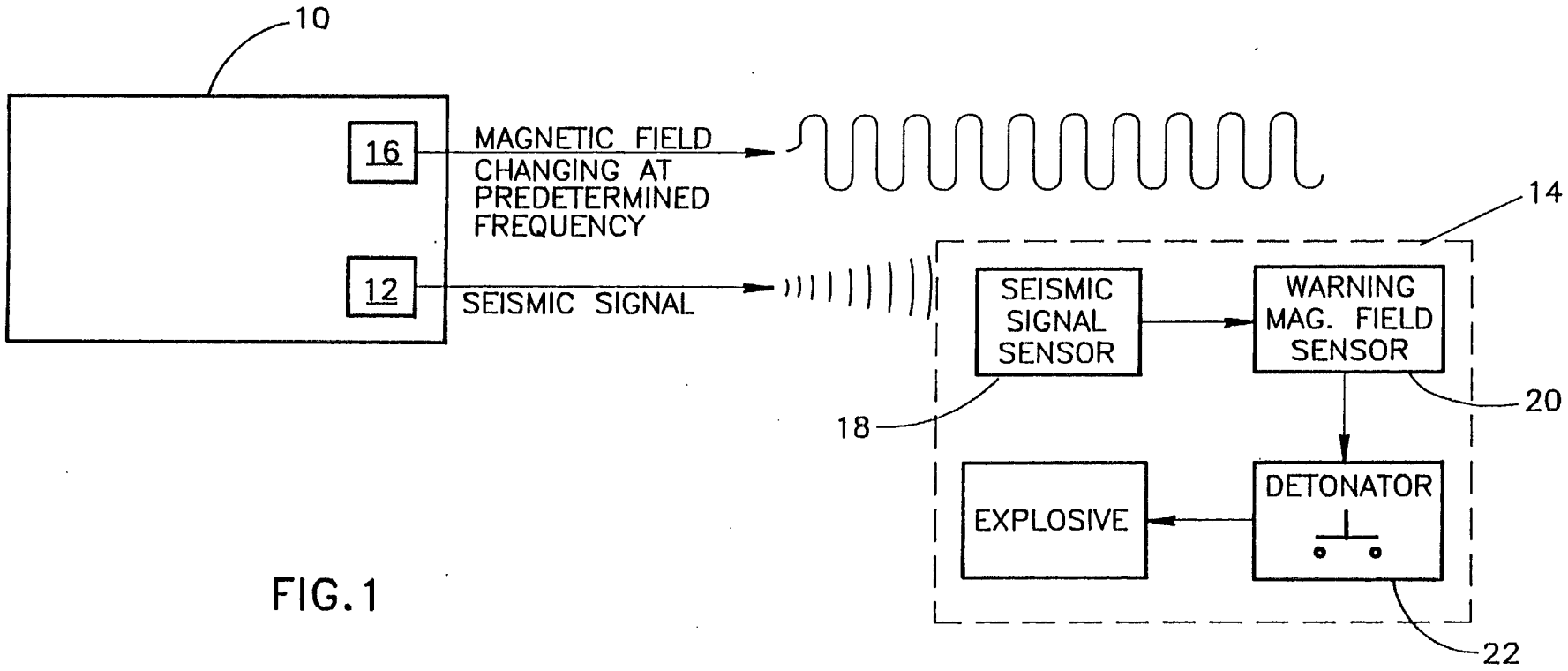
FIG. 1 is a block diagram illustration of a vehicle mounted seismo-magnetic mine detonation system, constructed and operative in accordance with the present invention.

Reference is made to FIG. 1, in which is illustrated a portion of a vehicle, referenced generally 10, on which there has been mounted a system for detonating seismo-magnetic mines, constructed and operative in accordance with an embodiment of the present invention.

As will be appreciated by persons skilled in the art, the detonation of most seismo-magnetic mines used in modern warfare occurs in response to a seismic signal within a predetermined frequency range and having at least a predetermined minimum intensity, and changes in the sensed magnetic field at a least a predetermined minimum frequency. The described seismic signal and changes in the magnetic field are selected by mine manufacturers to respectively correspond to portions of the seismic and magnetic 'signatures' of heavy vehicles e.g. main battle tanks, half tracks etc., as known in the art.

It has been found by the inventors that the seismic trigger mechanism of a seismo-magnetic mine may be activated by generating a seismic signal having a single frequency to which the mechanism is particularly sensitive. It has also been found that the magnetic trigger mechanism of a seismo-magnetic mine may be activated by causing changes, at at least a predetermined minimum frequency, in the magnetic field sensed by magnetic trigger apparatus forming part of the mine.

The present invention thus provides a vehicle mountable system which can be operated to activate both the seismic and magnetic trigger mechanisms in a seismo-magnetic mine so as to cause detonation thereof at a distance from the vehicle that is sufficient so as not to cause damage to the vehicle or to its occupants.

The system of the invention thus includes a seismic signal generator 12 for arming a typical seismo-magnetic mine 14 by emitting a seismic signal within the sensitive range of the mine. The system further includes magnetic apparatus 16 for detonating the mine by providing changes in the magnetic field sensed by the trigger mechanism of the mine at at least a minimum predetermined frequency.

A typical seismo-magnetic mine, such as the VS-HCT manufactured by Valsella Meccanotecnica Sea., 25014 Castemedelo, Brescia, Italy, includes a seismic sensor 18 and apparatus 20 for sensing changes in the magnetic field in its vicinity. Many seismo-magnetic mines are constructed such that an arming device (not shown) associated with the seismic sensor must be armed prior to any detection by sensor 20 of a change in the magnetic field. Where this occurs, detonation of the mine will take place as soon as a sufficient number of changes in the sensed magnetic field have been detected. In the event that the changes in the magnetic field provided by magnetic apparatus 16 are sensed by sensor 20 prior to the detection of a seismic signal from seismic signal generator 12, the mine will not be detonated. It is an important feature, therefore, that the effective radius or distance from the vehicle 10 that the seismic signal is sensed by seismic sensor 18 is greater than the distance from the vehicle 10 at which the magnetic field is sensed.

It will be appreciated that for a mine whose detonation is not dependent on the order in which the seismic signal and the magnetic field changes are detected, the relative ranges of the seismic signal and of the changing magnetic field may be varied.

It has been found by the inventors that for a large number of seismo-magnetic mines conventionally used, a seismic signal of about 500 W and at a frequency in the range 40–80 Hz is effective to detonate a mine at a distance of about 10 m.

Figure 2A:
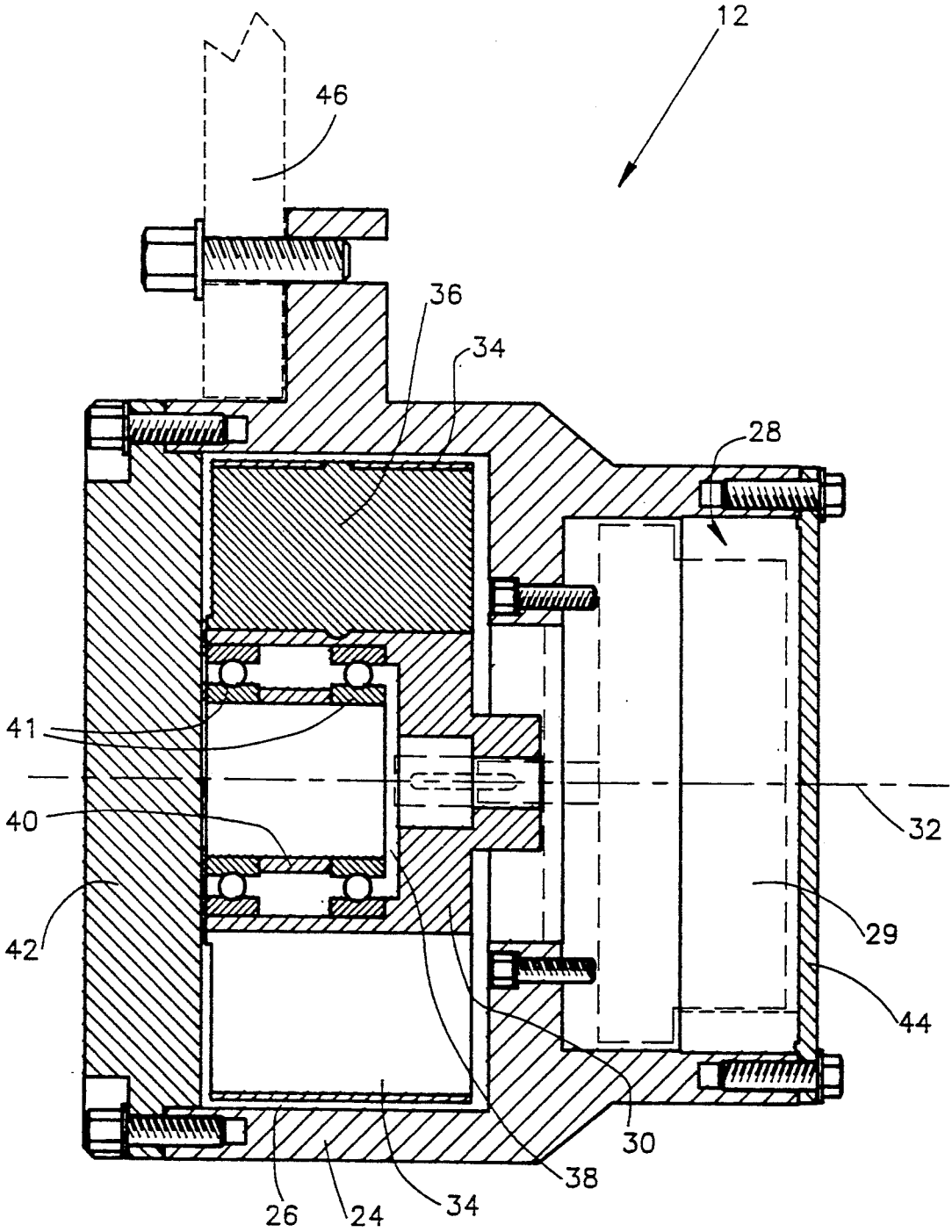
FIG. 2A is a detailed side sectional view of the seismic signal generator depicted schematically in FIG. 1.

Reference is now made to FIG. 2A, in which is shown a detailed view of the seismic signal generator 12 illustrated schematically in FIG. 1. It will be appreciated that the illustrated construction of the generator is merely an example of apparatus capable of providing a seismic signal of a selected intensity and at a selected frequency, and that any alternative apparatus providing a suitable seismic signal may be used in place of the illustrated apparatus.

Seismic signal generator 12 is, in the present example, a vibration producing unit which includes a rigid housing 24 having first and second communicating volumes, referenced 26 and 28 respectively. First volume 26 houses a rotor 30, mounted for rotation about a axis 32.

Figure 2C:
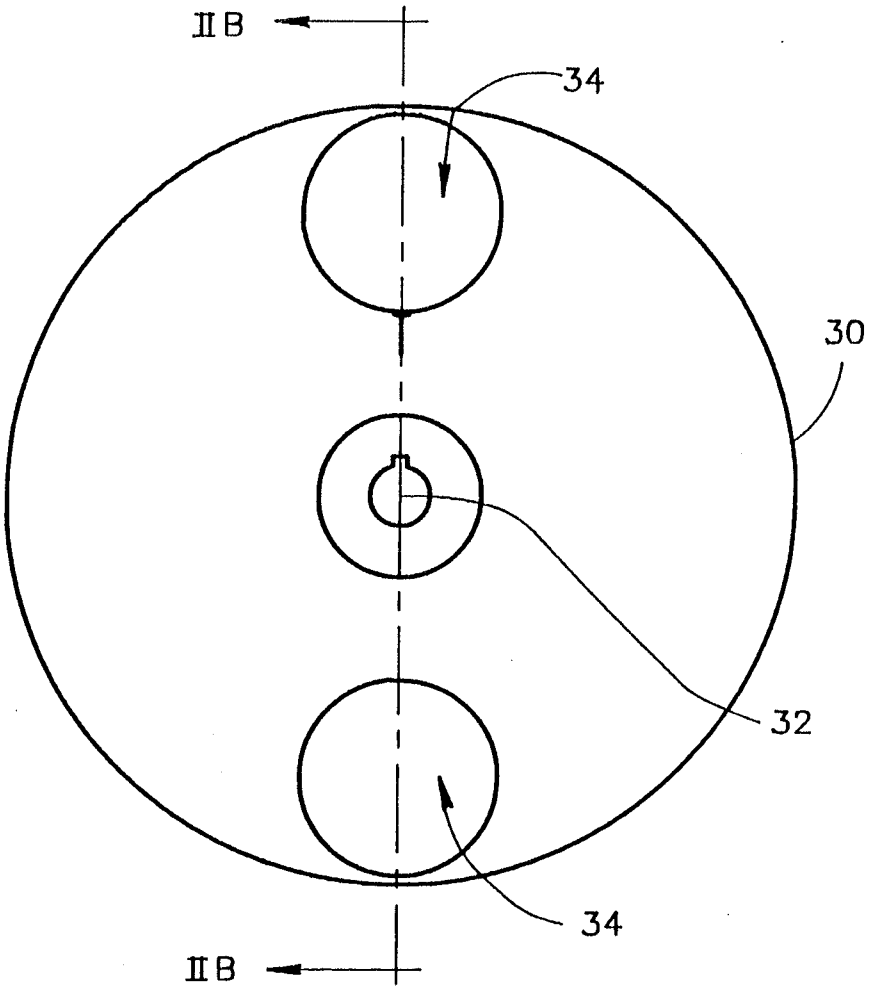
FIG. 2C is a plan view of the rotor illustrated in FIGS. 2A and 2B, taken in the direction of arrow IIC in FIG. 2B.
Figure 2B:
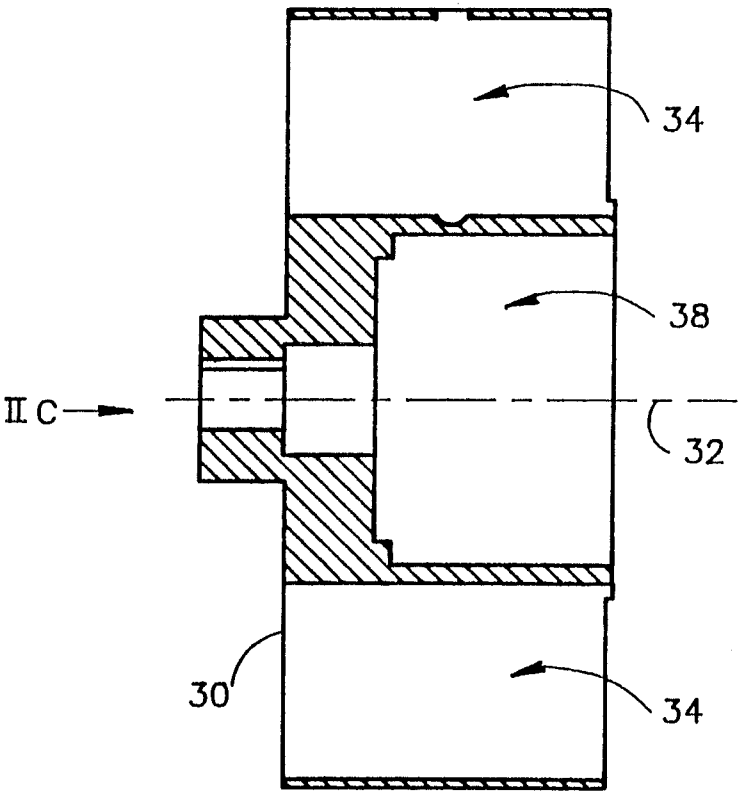
FIG. 2B is a side-sectional view of the rotor of the apparatus of FIG. 2A.

Referring now also to FIGS. 2B and 2C, rotor 30 defines typically a pair of bores 34 spaced apart along a common diameter. One of the bores, as illustrated in FIG. 2A, is filled with a mass 36 of a material having a specific weight greater than the material from which the remainder of the rotor is made. Typically, the rotor is made of aluminum and the mass 36 is made of lead. Rotor 30 also defines a central cavity 38 for receiving a bushing 40 and rotational bearings 41. First volume 26 is closed by a cover 42 bolted to housing 24.

Second volume 28 is configured to house a motor 29 coupled to rotor 30 along axis 32. Second volume 28 is closed by a cover 44. Typically, seismic signal generator 12 is mounted onto a vehicle (such as illustrated in any of FIGS. 4A, 5A and 5B, or 6A and 6B), as by a vertical flange 46, such that axis 32 is parallel to a ground surface across which the vehicle is travelling.

As rotor 32 is rotated its eccentric load causes a vibration, whose intensity and frequency are governed by the rotor weight and the speed of its rotation. The vibrations are transmitted to the ground via the vehicle, causing a seismic signal having an intensity and a frequency so as to cause the arming of a seismo-magnetic mine in the vicinity of the seismic signal generator.

Figure 3A:
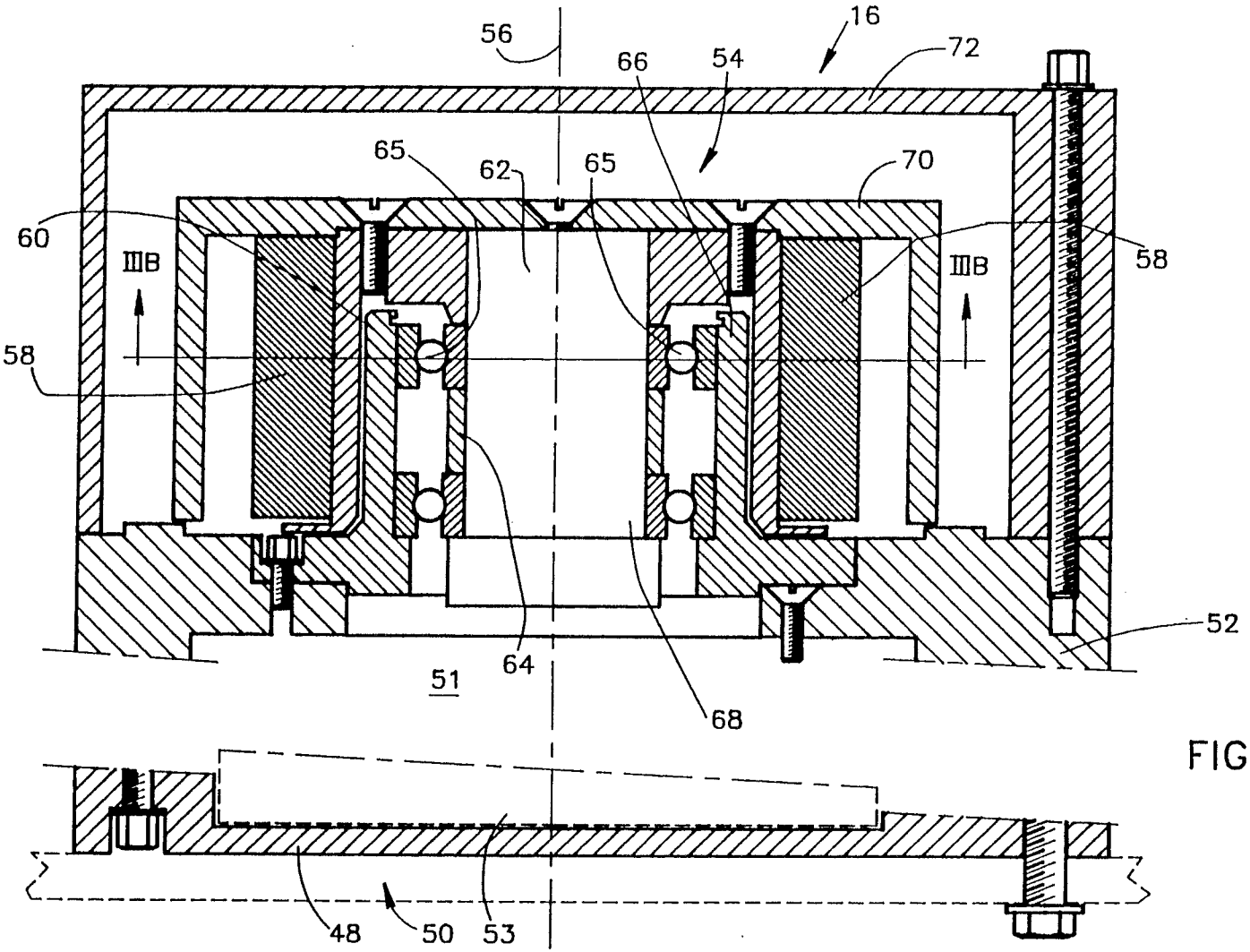
FIG. 3A is a detailed side sectional view of the magnetic apparatus depicted schematically in FIG. 1.
Figure 3B:
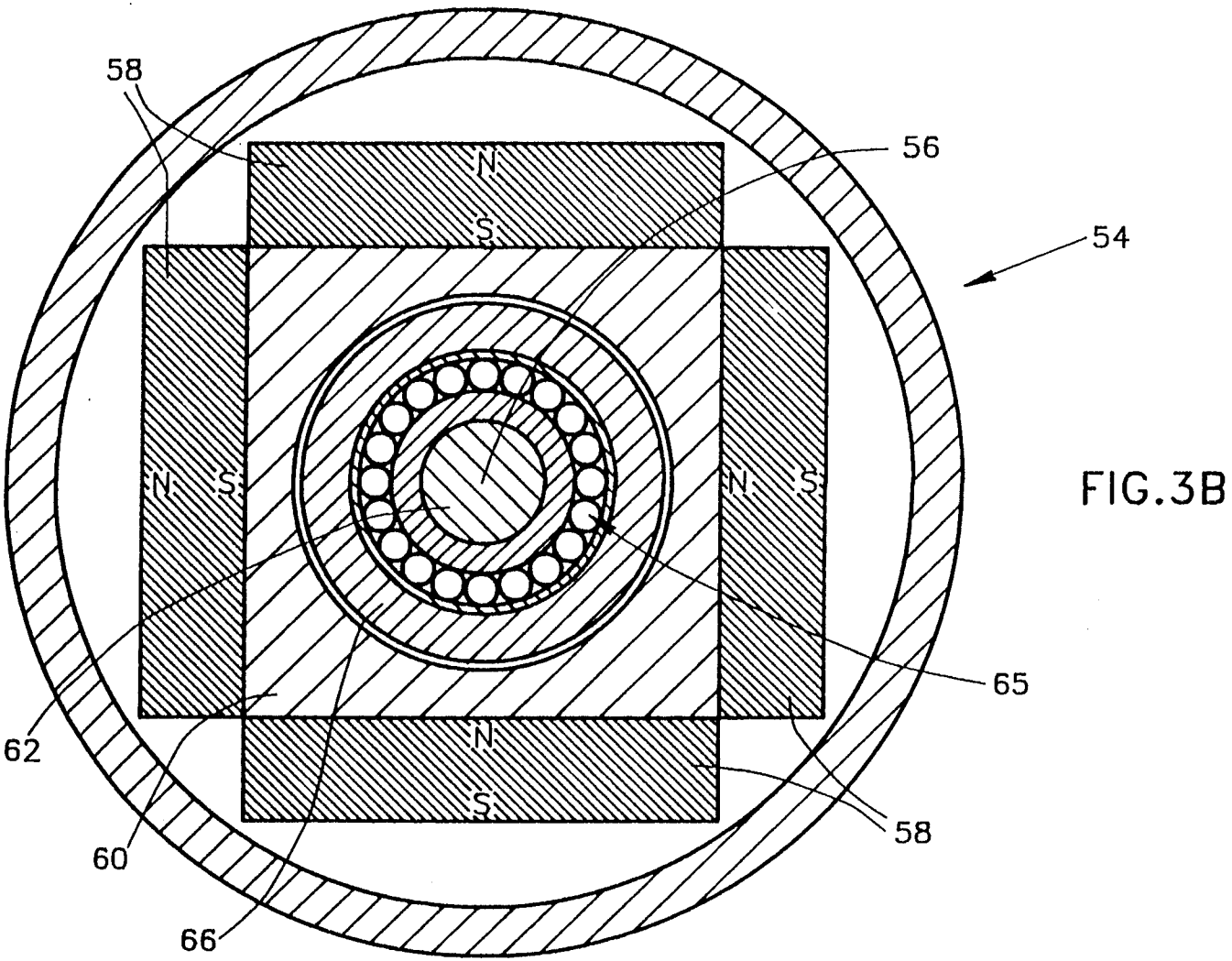
FIG. 3 is a reduced scale cross-sectional view taken along line IIIB—IIIB in FIG. 3A.

Reference is now made to FIGS. 3A and 3B, which are detailed views of an exemplary construction of magnetic apparatus 16. Apparatus 16 includes a base member 48 attached, as by a bolted connection, to a selected portion 50 of a vehicle (such as illustrated in any of FIGS. 4A, 5A and 5B, or 6A and 6B). Housed in a volume 51 defined between base member 48 and a body 52 is a motor 53 which, as will be appreciated is operative to rotate a magnetic element, denoted generally 54, about an axis 56.

In the present example element 54 includes a plurality of typically two pairs of typically elongate, mutually parallel permanent magnets 58 mounted onto a rotatable support member 60. Member 60 is attached to an axle 62 which is rotationally mounted along axis 56 by means of a bushing 64 (FIG. 3A) and rotational bearings 65, within a bearing housing 66 which is fixed to body 52. Axle 62 has a free end 68 (FIG. 3A) coupled to the motor 53 so as to be rotatable thereby. Element 54 is enclosed by an inner cover 70 (FIG. 3A) which is arranged for rotation with axle 62. An outer cover 72 (FIG. 3A) is attached to body 52.

It will be appreciated that although four magnets are illustrated in the present example, alternatively, a single magnet or any other any suitable number of magnets may be used.

Figure 4A:
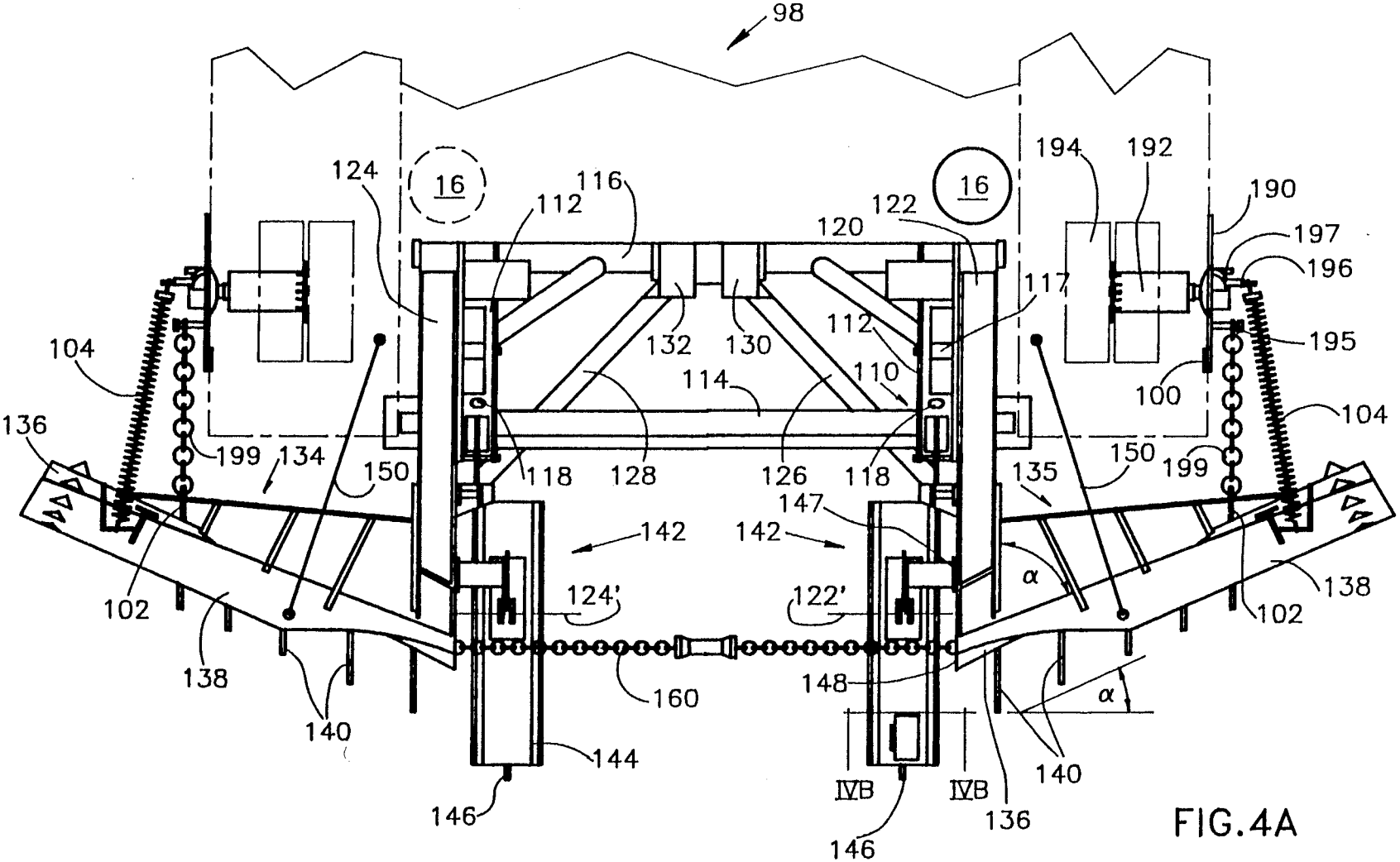
FIG. 4A is a schematic plan view of a front portion of a tracked vehicle having mounted thereon mine clearing apparatus incorporating the seismo-magnetic mine detonation system of the invention.

Reference is now made to FIG. 4A, which is a schematic plan view of a front portion of a tracked vehicle 98, e.g. an M-1 tank, having mounted thereon mine clearing apparatus incorporating the seismo-magnetic mine detonation system of the invention.

The mine clearing apparatus includes the seismo-magnetic mine detonation system of the invention, as described above in conjunction with FIGS. 1–3B, and mine field plowing apparatus, as described below in detail. It will be appreciated, however, that the illustrated mine field plowing apparatus, is merely one example of a system for the clearing non-seismo-magnetic mines and in conjunction with which the seismo-magnetic mine detonation system of the present invention may be used.

Thus, for example, any apparatus known in the art for exploding pressure-activated mines is also considered to be within the scope of the present invention, when taken in combination with the seismo-magnetic mine detonation system shown and described above in conjunction with FIGS. 1-3B.

The illustrated mine field plowing apparatus includes a frame 110 having a pair of identical side portions 112, which are joined at their front end by a cross bar 114 and at their rear end support by an axle 116. Frame 10 is rigidly mounted onto vehicle 98 by engagement of pins 117 located at side portions 112 with towline lugs fixed onto the vehicle. Rigidity of mounting is provided by bolts 118 which engage the underside of the tank and force mounting plates 120, fixedly mounted onto side portions 112 on the opposite side of pins 117, into tight engagement with the underside hull of the vehicle.

First and second arms 122 and 124 are independently rotatably mounted onto axle 116 and extend forwardly thereof in generally parallel planes. Arms 122 and 124 are strengthened by reinforcing elements 126 and 128 respectively which are fixed at one end thereof to the respective arms and are rotatably mounted by means of clamps 130 and 132 onto axle 116.

Rigidly mounted onto each of arms 122 and 124 is a mine plowing assembly 134. Each mine plowing assembly 134 has a main plow portion 136 of generally elongate configuration and concave cross section.

The general configuration of main plow portion 136 may be similar to that of an ordinary vehicle-powered snow plow. Disposed above main plow portion 136 and hinged thereonto is an auxiliary plow portion 138. Auxiliary plow portion 138 has two positions, a lowered position in which it extends forwardly of the surface of the main plow portion 136 and a raised position in which it defines an upper continuation of the surface of the main plow portion 136. This hinged construction is to obviate the problem of interference with a driver's field of vision or with the range of operation of the armament on a tank. Accordingly, the hinged auxiliary plow portion 138 may be lowered when the plowing assembly 134 is in its raised orientation.

Disposed below main plow portion 136 is a plurality of vertically disposed planar blades 140 which during operation are disposed below the ground surface. The horizontal spacing between adjacent vertical blades is selected to be such that anti-vehicle mines will of necessity be engaged thereby. The blades are provided with an inclined forward surface, so as to raise mines located under the ground surface into engagement with main plow portion 136, so that they may be plowed aside.

A desired depth of operation for blades 140 is determined by means of a gliding surface assemblies 142 which is articulatedly mounted, about respective pivot axes 122' and 124', onto each of arms 122 and 124. The gliding surface assembly 142 includes a sled 144 which is arranged to slide on the ground surface and is formed at its front with a vertical blade 146 for deflecting mines to the side thereof. Sled 144 is rotatably mounted onto a cam slot of a mounting plate 147. Mounting plate 147 is mounted in turn onto a mounting element 148. It is appreciated that sled 144 is permitted to undergo a somewhat complex articulated motion in a single plane within limits defined by the respective cam paths. This mounting arrangement permits selectable adjustment of the penetration depth of the plowing assembly 134 and also permits the sled 144 to be folded when the plowing assembly is in its raised orientation to eliminate interference with operation of the tank.

A chain 150 extends from each auxiliary plow portion 138 to a location on the hull of the vehicle. The length of the chain 150 is selected such that it is slack when the plowing assembly is in its raised orientation but becomes tight when the plowing assembly is lowered, thus pulling on auxiliary plow portion 138 and orienting it towards a generally vertical orientation. The full raised orientation of the auxiliary plow portion 138 is reached only when soil being plowed is forced thereagainst.

Apparatus for automatically lifting the mine plowing assembly is provided separately for each mine plow and comprises a freely rotatable disk 190 which is bearing mounted onto a mounting member 192 which is bolted onto a tension wheel 194 of a tank. Tension wheel 194 engages the tank track and maintains it at a desired tension. Mounted on an outer facing surface of disk 190 are three outer pins 195, 196 and 197 and an inner disposed pin (not shown). Mounted on an inner facing surface of disk 190 is a tooth 100 which is disposed ordinarily out of engagement with corresponding interstices defined between plates of the tank tread.

Mounted on pin 195 is a lifting chain 199 which is attached at its other end to a location 102 fixed onto main plow portion 136. Mounted on pin 196 is a spring 104 which is attached at its other end to main plow portion 136. Spring 104 is operative to urge disk 190 to rotate about its axis in an clockwise direction.

The operation of the plowing apparatus described hereinabove in conjunction with FIG. 4A is described and illustrated in detail in U.S. Pat. No. 4,467,694, the disclosure of which is incorporated herein by reference.

A weighted chain 160 is mounted between the two plowing assemblies to engage and detonate mines intended to be detonated by engagement of the underside of e.g. a tank, with an antenna protruding upward from the mines, such as known in the art. The position of the weighted chain is such that any of this type of mine encountered by the vehicle will be detonated at a safe distance therefrom.

Figure 4B:
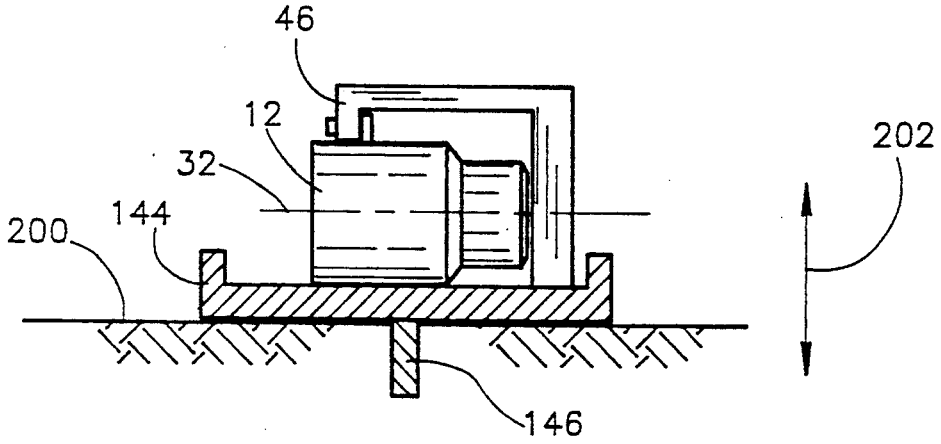
FIG. 4B is a schematic illustration of the mounting of the vibration apparatus of the system of the invention, taken along line IVB—IVB in FIG. 4A.

Referring now particularly to FIG. 4B, an enlarged view illustrating the mounting of seismic signal generator 12 of the seismo-magnetic mine detonation system of the present invention. Signal generator 12 is shown to be mounted onto sled 144 via a rigid connection to a flange member 46, which is welded, or otherwise fixed, to sled 144. As rotor 30 (FIGS. 2A-2C) is rotated about axis 32, which is preferably parallel to a ground surface 200, sled 144 is induced to vibrate transversely to the ground surface about its pivot axis 122' (FIG. 4A), as illustrated by arrow 202. The vibrations, which typically are the range 40-80 Hz and have a power of approximately 500 W, are conducted by the ground material in the form of a seismic signal so as to be sensed by the seismic sensor of a seismo-magnetic mine in the vicinity of the vehicle 98, thereby causing arming of the mine. It will be appreciated that although only a single signal generator 12 is provided, one or more additional generators may also be provided.

With further reference to FIG. 4A, magnetic apparatus 16 is shown to be mounted onto a portion 204 of vehicle 98, and is operable as described above in conjunction with FIGS. 1, 3A & 3B to cause detonation of a seismo-magnetic mine at a safe distance from the vehicle. Although a single apparatus 16 may be provided, in order to provide a more uniform magnetic field around the vehicle, any preferred number of apparatuses may be provided. An additional magnetic apparatus is illustrated at 16'.

Figure 5A:
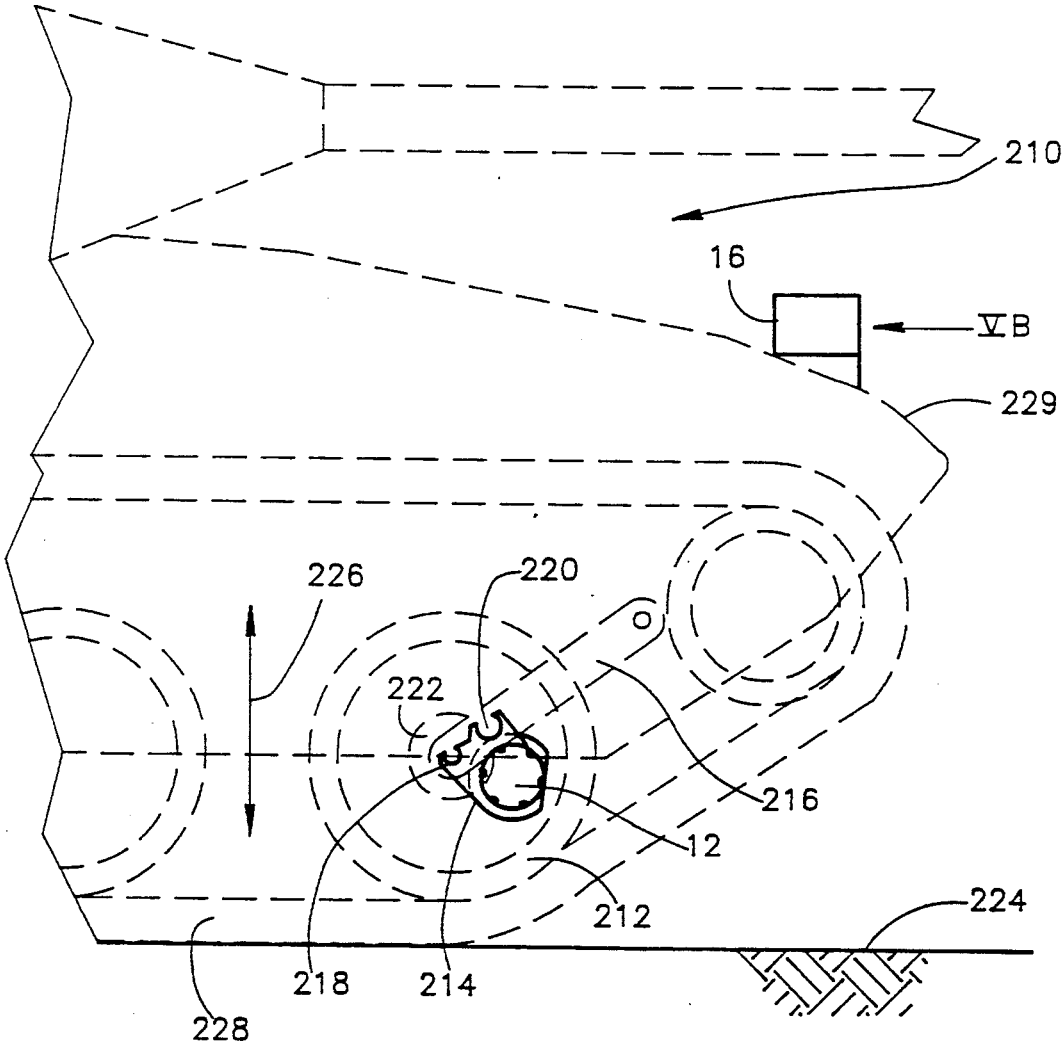
FIG. 5A is a schematic side-view illustration of a front portion of a tracked vehicle wherein the vibration apparatus of the seismo-magnetic mine detonation system is mounted in association with a road wheel of the vehicle.
Figure 5B:
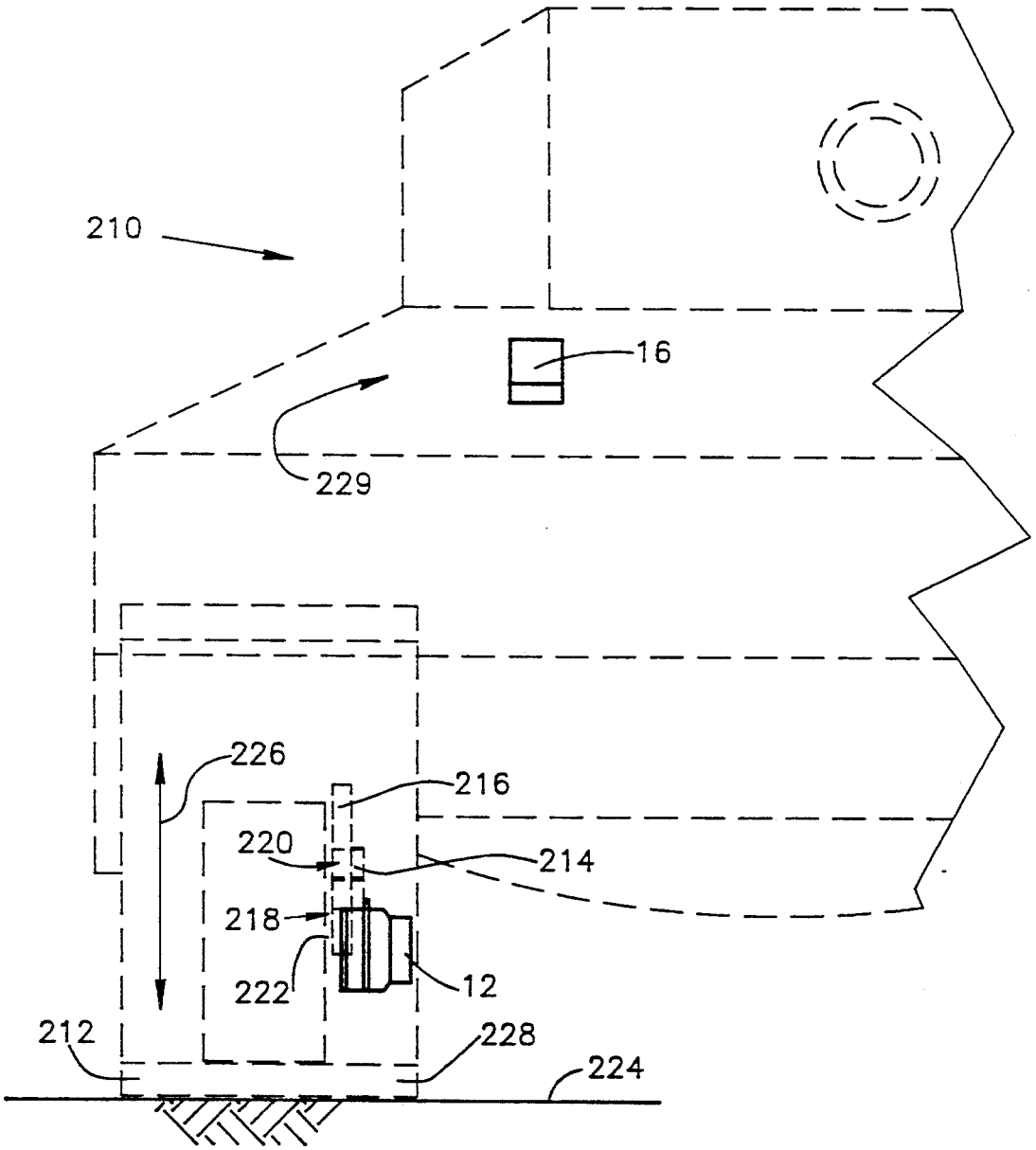
FIG. 5B is a front view of the portion of the vehicle illustrated in FIG. 5A, taken in the direction of arrow VB therein.

Reference is now made to FIGS. 5A and 5B, which are schematic illustrations of a front portion of a tracked vehicle 210, on which is mounted the seismo-magnetic mine detonation system of the invention. Vehicle 210 may be substantially any tracked vehicle, such as a main battle tank, as illustrated, or an armored personnel carrier.

The seismic signal generator 12 of the system is, in the present example, mounted in association with a road wheel 212. The mounting comprises a plate member 214 which is attached to a road wheel suspension member 216 via first and second bolted connections, respectively reference 218 and 220. First bolted connection 218 is preferably coaxial with the road wheel axle 222.

As rotor 30 (FIGS. 2A–2C) is rotated about its axis 32, which is preferably parallel to a ground surface 224, road wheel 212 is induced to vibrate in a direction indicated generally by arrow 226. The vibrations are conducted, via tracks 228, by the ground material in the form of a seismic signal so as to be sensed by the seismic sensor of a seismo-magnetic mine in the vicinity of the vehicle 210, thereby causing arming of the mine. It will be appreciated that although only a single seismic signal generator 12 is provided, one or more additional units may also be provided.

Magnetic apparatus 16 is shown to be mounted onto a hull portion 229 of vehicle 210, and is operable as described above in conjunction with FIGS. 1, 3A & 3B to cause detonation of a seismo-magnetic mine at a safe distance from the vehicle. Although a single apparatus 16 may be provided, in order to provide a more uniform magnetic field around the vehicle, any preferred number of apparatuses may be provided.

Figure 6A:
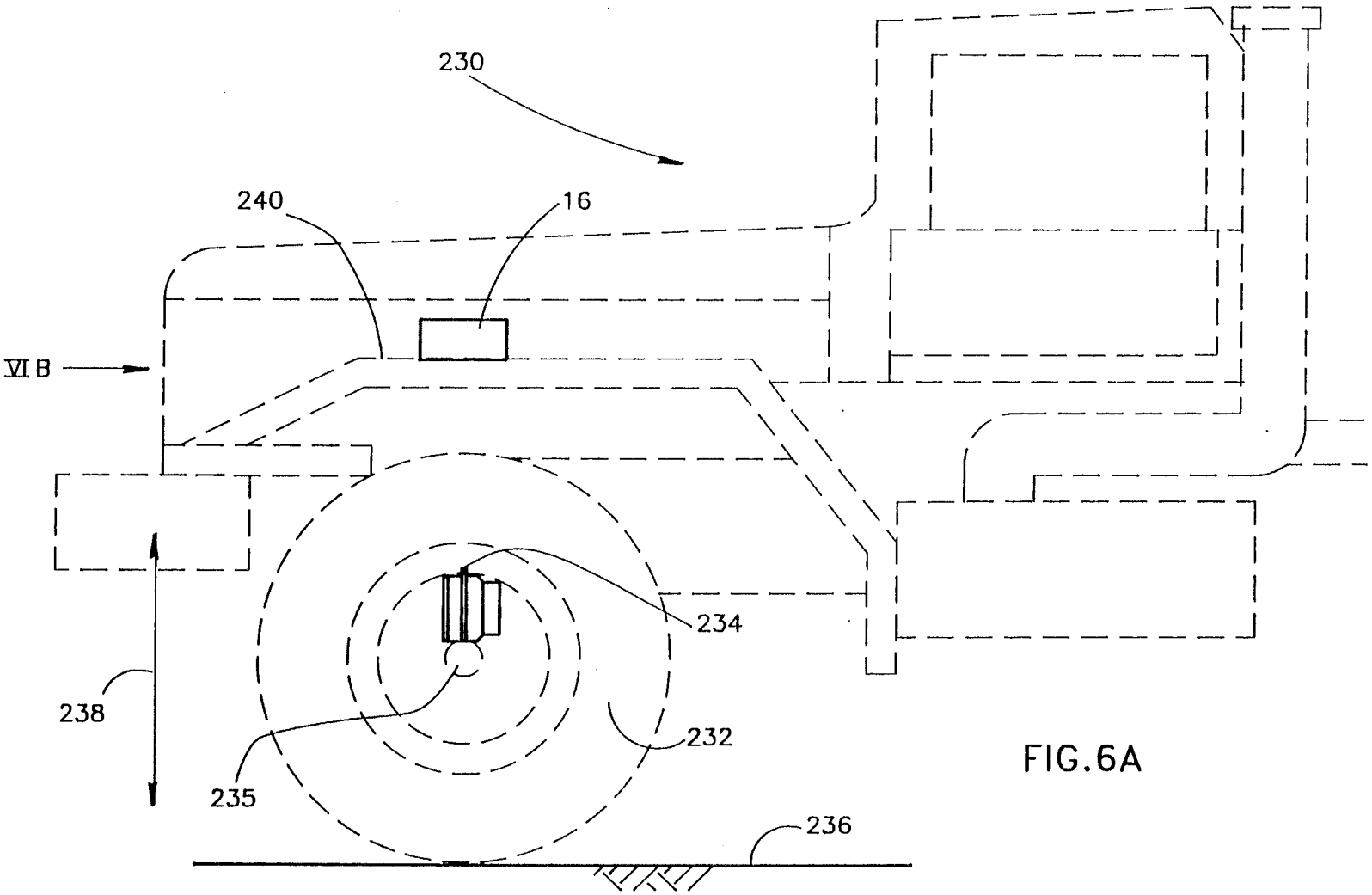
FIG. 6A is a schematic side-view illustration of a front portion of a wheeled vehicle onto which the vibration apparatus of the seismo-magnetic mine detonation system is mounted.
Figure 6B:
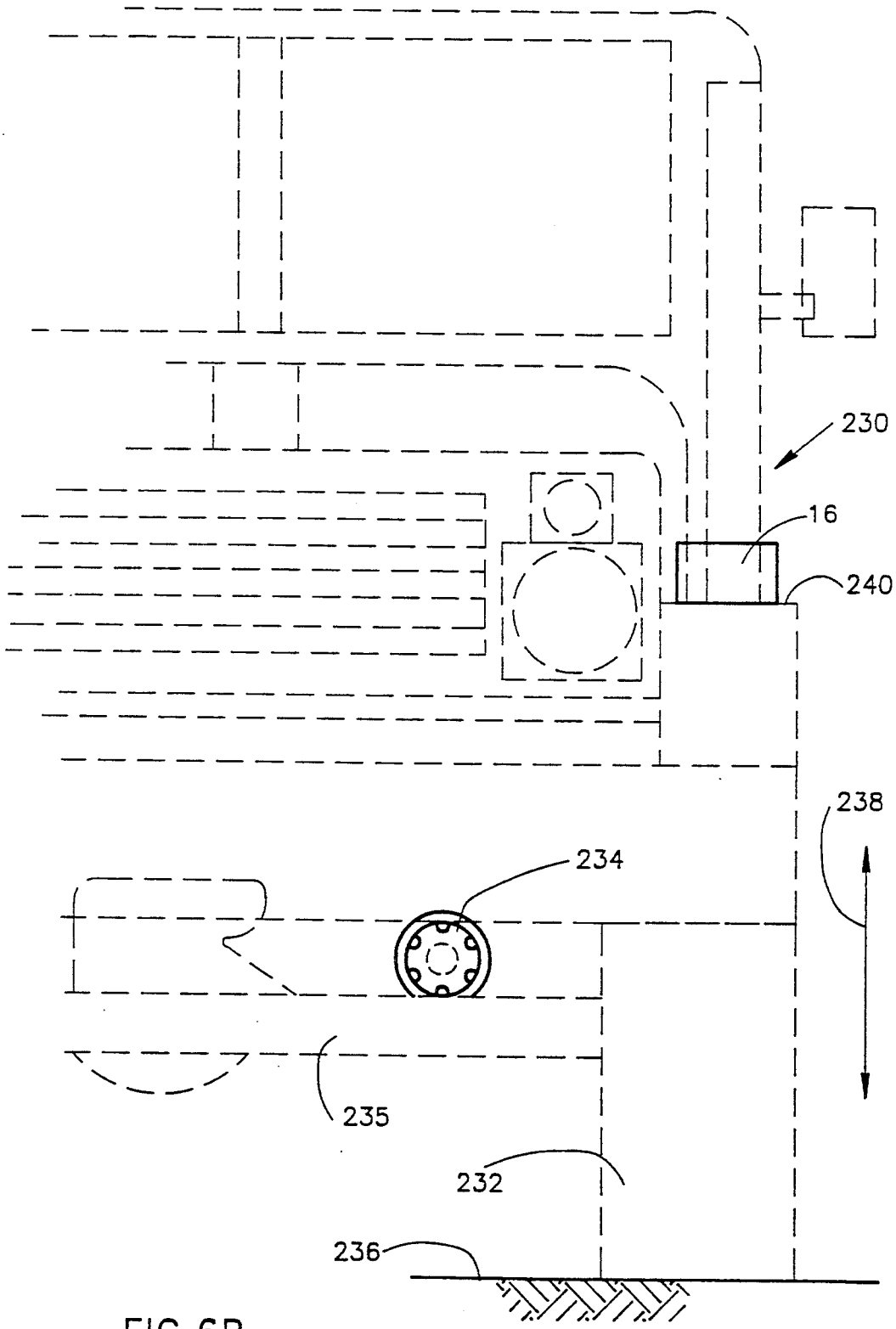
FIG. 6B is a front view of the portion of the vehicle illustrated in FIG. 6A, taken in the direction of arrow VIB therein.

Reference is now made to FIGS. 6A and 6B, in which are schematic illustrations of a front portion of a wheeled vehicle 230, on which is mounted the seismo-magnetic mine detonation system of the invention. Vehicle 230 may be any suitable vehicle, such as a truck. Alternatively, the wheeled vehicle may also have tracks, such as a half-track.

Seismic signal generator 12 of the system is, in the present example, mounted in association with a front wheel 232. The mounting comprises a plate member 234 which is attached, as by welding or bolting, to front axle 235.

As rotor 30 (FIGS. 2A–2C) is rotated about its axis 32, which is preferably parallel to a ground surface 236, wheel 232 is induced to vibrate in a direction indicated by arrow 238. The vibrations are conducted by the ground material in the form of a seismic signal so as to be sensed by the seismic sensor of a seismo-magnetic mine in the vicinity of the vehicle, thereby causing arming of the mine. It will be appreciated that although only a single seismic signal generator 12 is provided, one or more additional units may also be provided.

Magnetic apparatus 16 is shown to be mounted, for example, onto a portion 240 of vehicle 230, and is operable as described above in conjunction with FIGS. 1, 3A & 3B to cause detonation of a seismo-magnetic mine at a safe distance from the vehicle. Although a single apparatus 16 may be provided, in order to provide a more uniform magnetic field around the vehicle, any preferred number of apparatuses may be provided.

It will be appreciated by persons skilled in the art that the present invention is not limited by what has been particularly shown and described hereinabove. Rather the scope of the present invention si defined solely by the claims, which follow:

What is claimed is:

1. A vehicle mountable seismo-magnetic mine detonation system comprising:

means for vibrating at least a portion of a vehicle so as to provide a seismic signal which, when sensed by a seismo-magnetic mine located in ground material across which the vehicle is traveling,. causes at least arming of the mine when the vehicle is at at least a predetermined distance therefrom; and means,-associable with the vehicle, for modifying the magnetic field sensed by apparatus forming part of the seismo-magnetic mine so as to at least cause arming thereof when the vehicle is at at least a predetermined distance from the mine, said means for vibrating and means for modifying cooperating so as to cause detonation of the mine at at least a predetermined distance form the vehicle without causing unacceptable damage to the vehicle or to its occupants.

2. A system according to claim 1, and wherein said means for vibrating comprises means for generating a seismic signal having a frequency within a predetermined range of frequencies and having at least a predetermined intensity.

3. A system according to claim 1, and wherein said means for modifying the magnetic field comprises:

at least one magnetic means defining opposite poles, for providing a magnetic field; and means for rotating said at least one magnetic means at at least a predetermined speed so as to vary said magnetic field at at least a predetermined frequency.

4. A system according to claim 1, and wherein said means for vibrating comprises means for arming a seismo-magnetic mine, and said means for modifying comprises means for detonating the seismo-magnetic mine.

5. A system according to claim 4, and wherein said means for vibrating comprises means for generating a seismic signal that is sensible by the mine when the vehicle is at a first distance therefrom and said means for modifying comprises means for modifying the magnetic field sensed by apparatus forming part of the mine when the vehicle is at a second distance therefrom, said second distance being shorter than said first distance.

6. A system according to claim 1, and wherein said means for modifying comprises:

means for providing a magnetic field; and means for varying the magnetic field in the vicinity of the mine at at least a predetermined frequency.

7. A system according to claim 6, and wherein said means for providing a magnetic field comprises at least one magnetic means defining opposite poles, and said means for varying comprises means for rotating each said magnetic means at at least a predetermined speed so as to vary said magnetic field at at least said predetermined frequency.

8. Mobile mine clearing apparatus comprising:

a vehicle; and a vehicle mountable seismo-magnetic mine detonation system comprising:

means for vibrating at least a portion of said vehicle so as to provide a seismic signal which, when sensed by a seismo-magnetic mine located in ground material across which said vehicle is traveling, causes at least arming of the mine when the vehicle is at at least a predetermined distance therefrom; and means, associable with said vehicle, for modifying the magnetic field sensed by apparatus forming part of the seismo-magnetic mine so as to at least cause arming thereof when said vehicle is at at least a predetermined distance from the mine, said means for vibrating and means for modifying cooperating so as to cause detonation of the mine at at least a predetermined distance from said vehicle without causing unacceptable damage to said vehicle or to its occupants.

9. Apparatus according to claim 8, and wherein said means for vibrating comprises means for generating a seismic signal having a frequency with a predetermined range of frequencies and having at least a predetermined intensity.

10. Apparatus according to claim 8, and wherein said vehicle is a wheeled vehicle and said means for vibrating at least a portion of said vehicle comprises means for vibrating a predetermined wheel of said vehicle.

11. Apparatus according to claim 8, and wherein said vehicle is a tracked vehicle and said means for vibrating at least a portion of said vehicle comprises means for vibrating a predetermined road wheel of said vehicle.

12. Apparatus according to claim 8, and wherein said means for modifying the magnetic field comprises:

at least one magnetic means defining opposite poles, for providing a magnetic field; and means for rotating said at least one magnetic means at at least a predetermined speed so as to vary said magnetic field at at least a predetermined frequency.

13. Apparatus according to claim 8, and wherein said means for vibrating comprises means for arming a seismo-magnetic mine, and said means for modifying comprises means for detonating the seismo-magnetic mine.

14. Apparatus according to claim 13, and wherein said means for vibrating comprises means for generating a seismic signal that is sensible by the mine when said vehicle is at a first distance therefrom and said means for modifying comprises means for modifying the magnetic field sensed by apparatus forming part of the mine when said vehicle is at a second distance therefrom, said second distance being shorter than said first distance.

15. Apparatus according to claim 8, and wherein said means for modifying comprises:

means for providing a magnetic field; and means for varying the magnetic field in the vicinity of the mine at at least a predetermined frequency.

16. Apparatus according to claim 15, and wherein said means for providing a magnetic field comprises at least one magnetic means defining opposite poles, and said means for varying comprises means for rotating each said magnetic means at at least a predetermined speed so as to vary said magnetic field at at least said predetermined frequency.

17. A vehicle mountable combination mine clearing system comprising:

apparatus, associable with a vehicle, for clearing a safely traversable path through a field of pressure-activated mines; and a seismo-magnetic mine detonation system associated with said apparatus for clearing and comprising:

means for vibrating at least a portion of said apparatus for clearing so as to provide a seismic signal which, when sensed by a seismo-magnetic mine located in ground material across which the vehicle is traveling, causes at least arming of the mine when the vehicle is at at least a predetermined distance therefrom; and means for modifying the magnetic field sensed by apparatus forming part of the seismo-magnetic mine so as to at least cause arming thereof when the vehicle is at at least a predetermined distance from the mine, said means for vibrating and means for modifying cooperating so as to cause detonation of the mine at at least a predetermined distance from the vehicle without causing unacceptable damage to the vehicle or to its occupants.

18. A system according to claim 17, and wherein said means for vibrating comprises means for generating a seismic signal having a frequency within a predetermined range of frequencies and having at least a predetermined intensity.

19. A system according to claim 17, and wherein said means for vibrating comprises means for arming a seismo-magnetic mine, and said means for modifying comprises means for detonating the seismo-magnetic mine.

20. A system according to claim 19, and wherein said means for vibrating comprises means for generating a seismic signal that is sensible by the mine when the vehicle is at a first distance therefrom and said means for modifying comprises means for modifying the magnetic field sensed by apparatus forming part of the mine when the vehicle is at a second distance therefrom, said second distance being shorter than said first distance.

21. A system according to claim 17, and wherein said means for modifying comprises:

means for providing a magnetic field; and means for varying the magnetic field in the vicinity of the mine at at least a predetermined frequency.

22. A system according to claim 21, and wherein said means for providing a magnetic field comprises at least one magnetic means defining opposite poles, and said means for varying comprises means for rotating each said magnetic means at at least a predetermined speed so as to vary said magnetic field at at least said predetermined frequency.

23. Mobile mine clearing apparatus comprising:

a vehicle;

apparatus, mounted on said vehicle, for clearing a safely traversable path through a field of pressure activated mines; and a seismo-magnetic mine detonation system associated with said apparatus for clearing and comprising:

means for vibrating at least a portion of said apparatus for clearing so as to provide a seismic signal which, when sensed by a seismo-magnetic mine located in ground material across which said vehicle is traveling, causes at least arming of the mine when said vehicle is at at least a predetermined distance therefrom; and means for modifying the magnetic field sensed by apparatus forming part of the seismo-magnetic mine so as to at least cause arming thereof when said vehicle is at at least a predetermined distance from the mine, said means for vibrating and means for modifying cooperating so as to cause detonation of the mine at at least a predetermined distance form said vehicle without causing unacceptable damage to said vehicle or to its occupants.

24. A system according to claim 23, and wherein said means for vibrating comprises means for generating a seismic signal having a frequency within a predetermined range of frequencies and having at least a predetermined intensity.

25. A system according to claim 23, and wherein said means for vibrating comprises means for arming a seismo-magnetic mine, and said means for modifying comprises means for detonating the seismo-magnetic mine.

26. A system according to claim 25, and wherein said means for vibrating comprises means for generating a seismic signal that is sensible by the mine when said vehicle is at a first distance therefrom and said means for modifying comprises means for modifying the magnetic field sensed by apparatus forming part of the mine when said vehicle is at a second distance therefrom, said second distance being shorter than said first distance.

27. A system according to claim 23, and wherein said means for modifying comprises:

means for providing a magnetic field; and means for varying the magnetic field in the vicinity of the mine at at least a predetermined frequency.

28. A system according to claim 27, and wherein said means for providing a magnetic field comprises at least one magnetic means defining opposite poles, and said means for varying comprises means for rotating each said magnetic means at at least a predetermined speed so as to vary said magnetic field at at least said predetermined frequency.

* * * * *